US010317137B2

(12) United States Patent
Kim et al.

(10) Patent No.: US 10,317,137 B2
(45) Date of Patent: Jun. 11, 2019

(54) WASHSTAND FURNITURE

(71) Applicant: LG ELECTRONICS INC., Seoul (KR)

(72) Inventors: Jongseok Kim, Seoul (KR); Inhyung Yang, Seoul (KR); Daeyun Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/915,216

(22) Filed: Mar. 8, 2018

(65) Prior Publication Data

US 2018/0259255 A1 Sep. 13, 2018

(30) Foreign Application Priority Data

Mar. 8, 2017 (KR) ..... 10-2017-0029740

(51) Int. Cl.

| | |
|---|---|
| ***E03C 1/32*** | (2006.01) |
| ***F26B 9/06*** | (2006.01) |
| ***E03C 1/04*** | (2006.01) |
| ***E03C 1/14*** | (2006.01) |
| ***F26B 3/04*** | (2006.01) |

(52) U.S. Cl.

CPC ..... *F26B 9/066* (2013.01); *E03C 1/04* (2013.01); *E03C 1/14* (2013.01); *E03C 1/32* (2013.01); *F26B 3/04* (2013.01)

(58) Field of Classification Search

CPC ..... E03C 1/32; A47K 1/02; A47K 2210/00

USPC ..... 4/630

See application file for complete search history.

(56) References Cited

U.S. PATENT DOCUMENTS

| | | | | |
|---|---|---|---|---|
| 2,175,329 | A * | 10/1939 | Watt | E03C 1/044 237/19 |
| 2,287,657 | A * | 6/1942 | Wisckol | D06F 1/00 312/140.2 |
| 5,522,411 | A | 6/1996 | Johnson | |
| 2007/0157378 | A1 | 7/2007 | Kendall et al. | |
| 2008/0256826 | A1 | 10/2008 | Zarembinski | |
| 2014/0366262 | A1* | 12/2014 | Flynn | E03C 1/186 4/514 |
| 2015/0252515 | A1 | 9/2015 | Henry et al. | |
| 2016/0128528 | A1 | 5/2016 | Stewen et al. | |

OTHER PUBLICATIONS

U.S. Notice of Allowance dated Oct. 19, 2018 issued in co-pending U.S. Appl. No. 15/915,236.

* cited by examiner

*Primary Examiner* — Janie M Loeppke
(74) *Attorney, Agent, or Firm* — KED & Associates, LLP

(57) ABSTRACT

A washstand may include a wash device that includes a wash bowl, a water supply assembly that supplies water to the wash bowl, and a drainage assembly that drains the water supplied to the wash bowl. The washstand may further include an inner cabinet disposed under the wash bowl, an outer cabinet provided to cover an outside of the inner cabinet, and a frame for fastening the inner cabinet and the outer cabinet and for supporting a load of the wash device.

19 Claims, 9 Drawing Sheets

WASHSTAND FURNITURE

CROSS-REFERENCE TO RELATED APPLICATION(S)

This application claims the priority benefit of Korean Patent Application No. 10-2017-0029740, filed in Korea on Mar. 8, 2017 in the Korean Intellectual Property Office, the disclosure of which is incorporated herein by reference.

U.S. application Ser. No. 15/915,193; Ser. No. 15/915,364; Ser. No. 15/915,267; Ser. No. 15/915,332; Ser. No. 15/915,401; Ser. No. 15/915,480; Ser. No. 15/915,421; Ser. No. 15/915,216; Ser. No. 15/915,236, all filed on Mar. 8, 2018, are related and are hereby incorporated by reference in their entirety. Further, one of ordinary skill in the art will recognize that features disclosed in these above-noted applications may be combined in any combination with features disclosed herein.

BACKGROUND

1. Field

The present disclosure relates to washstand furniture that utilizes the space under a washstand, and more particularly to washstand furniture having a module received therein.

2. Background

Washstand furniture having a module received therein are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Exemplary embodiments of a washstand furniture according to the present disclosure will be described with reference to the accompanying drawings.

A bathroom may have limited storage space for storing bathroom goods. For this reason, furniture may be disposed in the space above or under a sink in order to provide a storage space. In general, washstand furniture (or washstand, vanity) is a sink having a stand formed as an enclosure that utilizes the space under the sink to serve as a storage space, like a piece of furniture. Merely for ease of discussion, a washstand furniture will be referred to herein as a washstand or vanity.

Since furniture washstand is a structure installed in a bathroom, which is humid, the washstand is easily exposed to moisture, whereby the storage space in the washstand may be easily contaminated. In addition, water supply and drainage devices are disposed in the washstand. Consequently, the space in the washstand may be easily contaminated due to water discharged from the water supply and drainage devices.

Furthermore, since the washstand is disposed under the sink in order to support the sink, the storage space in the washstand may be easily deformed due to the load of the sink or external impact. The washstand of the present disclosure addresses these as well as other disadvantages.

One aspect of the present disclosure to provide washstand having a stable structure that is capable of safely managing a storage space. Another aspect of the present disclosure to provide washstand that is capable of stably supporting a sink while having a storage space defined therein.

Figure 1:
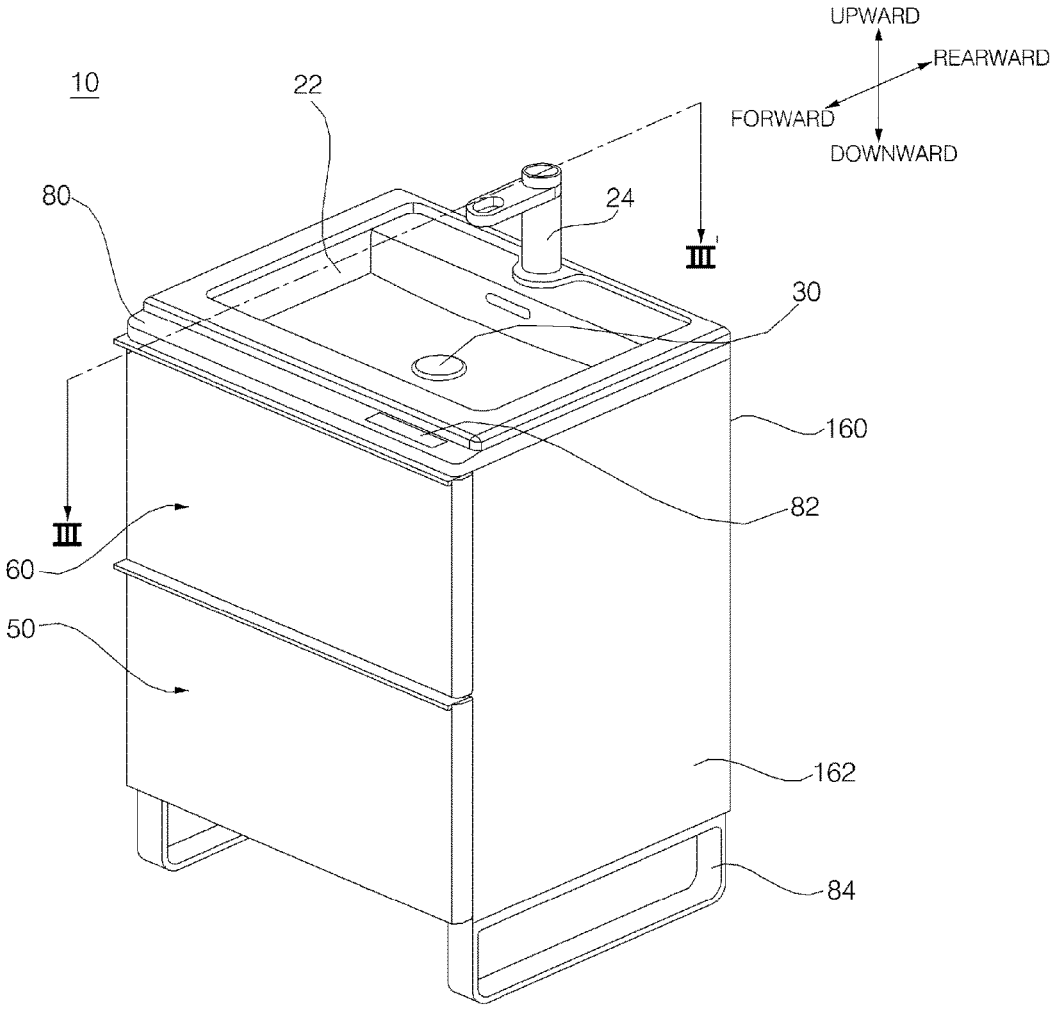
FIG. 1 is a perspective view showing washstand furniture according to an embodiment of the present disclosure.
Figure 2:
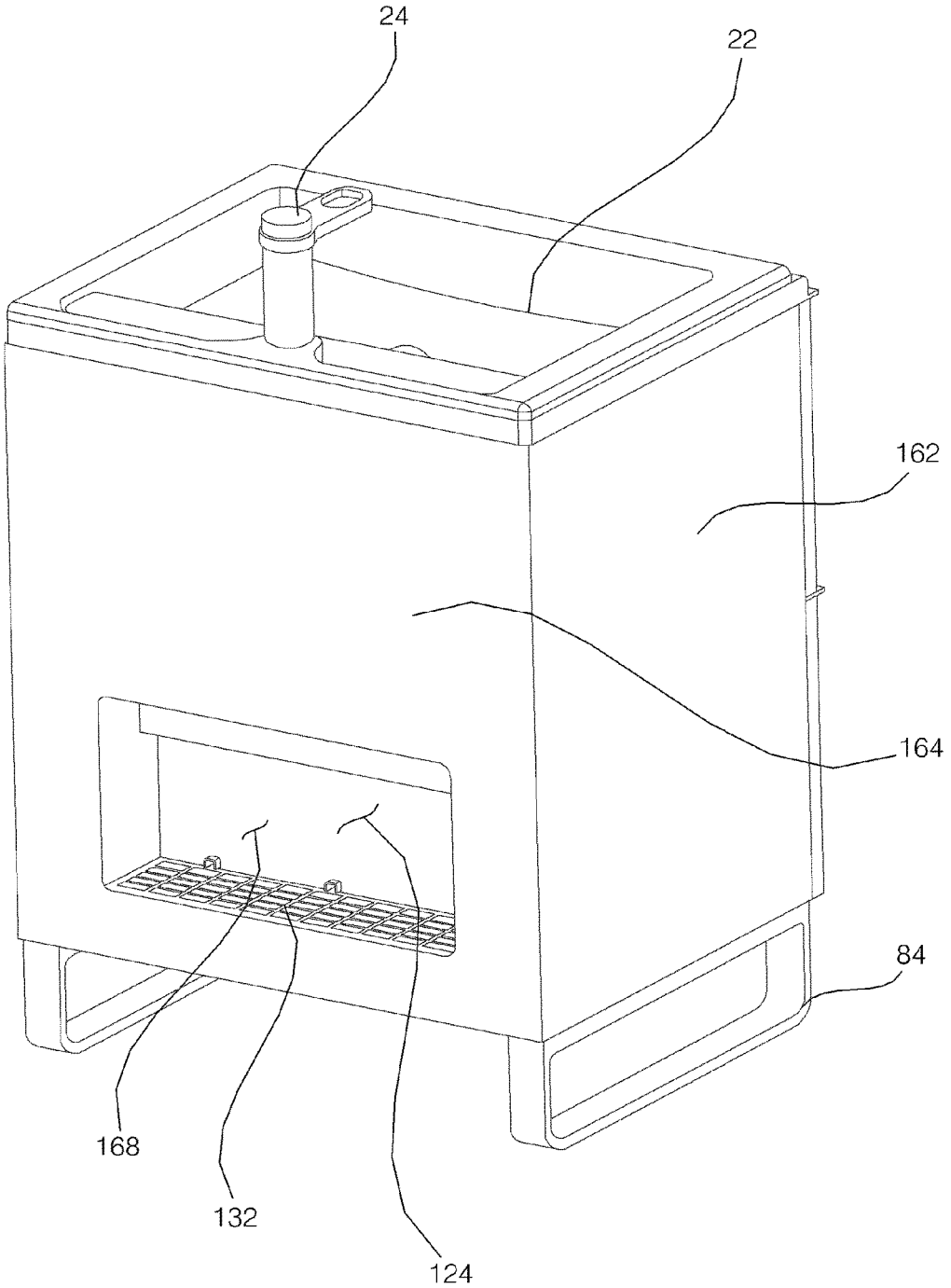
FIG. 2 is a rear perspective view showing the washstand furniture according to the embodiment of the present disclosure.
Figure 3:
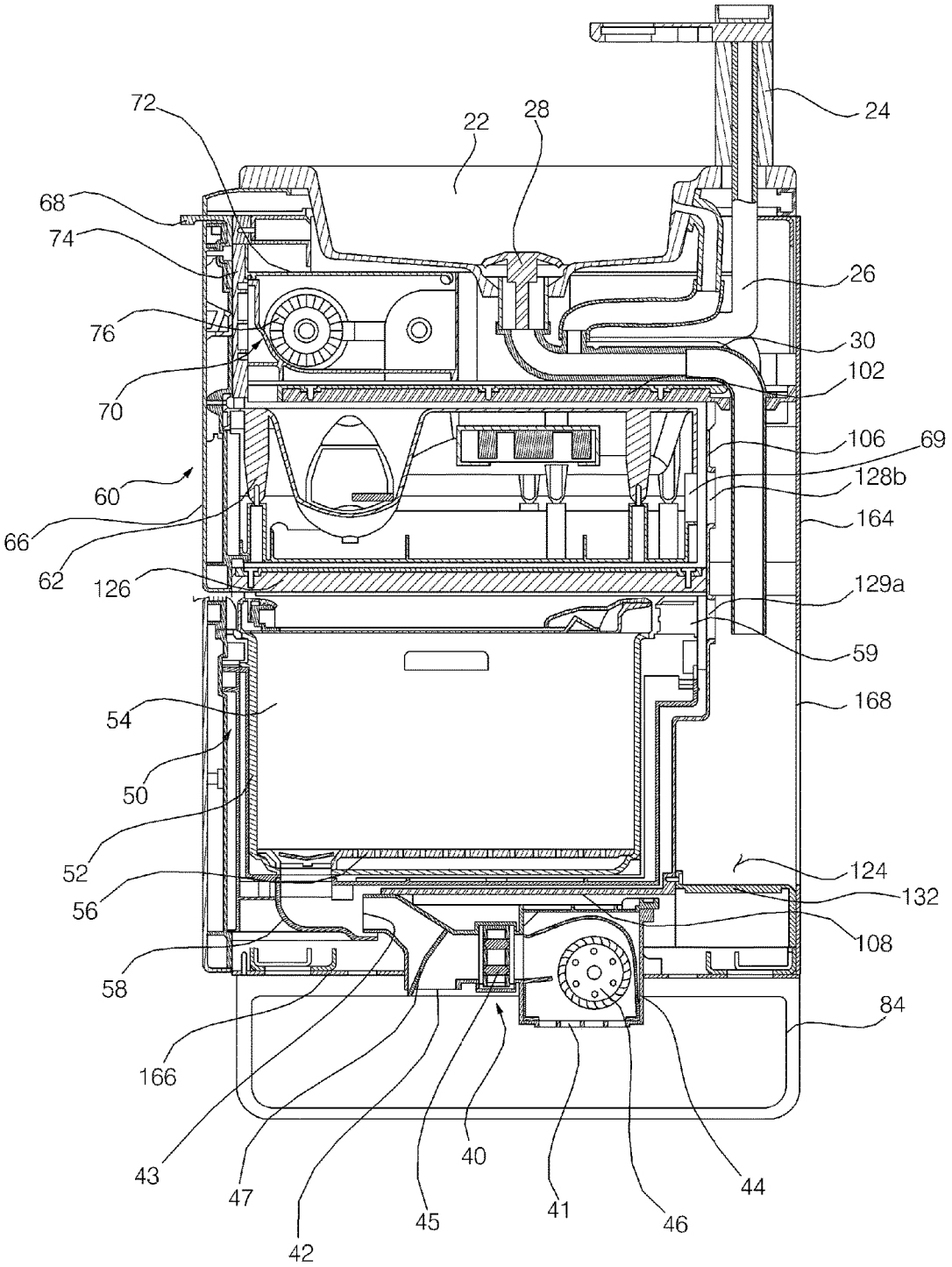
FIG. 3 is a sectional view taken along line III-III' of FIG. 1.

FIG. 1 is a perspective view showing a washstand according to an embodiment of the present disclosure. FIG. 2 is a rear perspective view showing the washstand. FIG. 3 is a sectional view taken along line III-III' of FIG. 1. The washstand 10 may include: a wash device including a wash bowl 22 (or sink, basin, bowl), a water supply assembly for supplying water to the wash bowl, and a drainage assembly for draining the water supplied to the wash bowl; an inner cabinet 100 disposed under the wash bowl, the inner cabinet having a space defined therein; an electrically operated module disposed in the inner cabinet; an outer cabinet 160 covering the outside of the inner cabinet; and a frame for fastening the inner cabinet and the outer cabinet and for supporting the load of the wash device.

Referring to FIG. 1, in the washstand 10 according to this embodiment, the direction in which the module is withdrawn from the cabinet will be referred to as a forward direction, the direction opposite the forward direction will be referred to as a rearward direction, the direction in which the wash bowl 22 is disposed will be referred to as an upward direction, and the direction in which legs of the washstand are disposed will be referred to as a downward direction, but the same are defined for convenience of description and are not intended to limit the scope of the disclosure.

The wash device is a device which may be provided at the wall of a restroom, e.g., a washroom, for allowing a user to wash his/her face or hands. The wash device includes a wash bowl 22 for storing water necessary to perform washing, a water supply assembly for supplying water to the wash bowl 22, and a drainage assembly for draining the water supplied to the wash bowl 22.

An enamel wash bowl or a ceramic wash bowl may be used as the wash bowl 22. In this embodiment, an enamel wash bowl may be used, since the enamel wash bowl can be variably deformed and the lower part of the enamel wash bowl can be easily coupled to the cabinet. The wash bowl 22 may be disposed at the upper part of the washstand 10.

The water supply assembly may include a water supply valve 24 for controlling the supply of water to the wash bowl 22 and a water supply hose 26 for supplying water to the water supply valve 24. The water supply valve 24 may be disposed at one side of the wash bowl 22 for supplying water to the wash bowl 22. The water supply hose 26 may include a hot water hose for supplying hot water and a cold water hose for supplying cold water.

The water supply assembly may further include a water purification filter 76 for purifying the water that is introduced into the water supply hose 26. The water purification filter 76 purifies the water that is discharged to the wash bowl 22 via the water supply valve 24.

The drainage assembly may include a drainage pipe 30 for discharging the water stored in the wash bowl 22 to the outside and a popup valve 28 for storing the water in the wash bowl 22 or draining the water stored in the wash bowl 22 to the drainage pipe 30.

The cabinet, which defines the external appearance of the washstand 10, may be disposed under the wash bowl 22. The cabinet maintains the rigidity of the washstand 10 and provides a space in which the module may be received. The module received in the cabinet may be an electrically operated device. The interior of the cabinet may be hollow, and the front of the cabinet is open.

The cabinet may include an inner cabinet 100 for receiving the module therein and an outer cabinet 160 disposed outside the inner cabinet 100 for maintaining the rigidity of the washstand. The module disposed in the washstand 10 may be divided into inner modules (or simply "modules") 50 and 60 disposed in the inner cabinet 100 and an additional module 70 (or second module) disposed outside the inner cabinet.

The washstand 10 may include an inner cabinet 100 and an outer cabinet 160 such that water is doubly prevented from being introduced into the modules disposed in the inner cabinet 100. The inner cabinet 100 and the outer cabinet 160 may be connected to each other via a frame 140. Hereinafter, the inner cabinet 100, the outer cabinet 160, and the frame 140, which comprise the structure of the washstand 10, will be described in detail.

The washstand 10 may further include an air conditioner 40 (or dryer) for discharging air through a discharge port connected to the interior of the cabinet, a first module 50 disposed in the cabinet for drying objects such as bathroom utensils disposed therein using the air discharged from the air conditioner 40, and a second module 60 disposed in the cabinet for receiving and drying separate components such as a residual water suction device for suctioning liquid. The washstand 10 may further include a third module 70 disposed between the cabinet and the wash bowl 22.

The air conditioner 40, which is used in the washstand 10, may discharge air to dehumidify the floor of the bathroom or to dry the interiors of the modules disposed in the cabinet. The air conditioner 40 may discharge air through a first discharge port 42 facing the floor of the bathroom or through a second discharge port 43 connected to the interior of the cabinet using a fan 46.

The air conditioner 40 may be disposed under the inner cabinet 100. The air conditioner 40 may discharge air to a space defined in the inner cabinet 100. The air conditioner 40 may discharge air to the first module 50, which is disposed in the inner cabinet 100, from under the inner cabinet 100. The air conditioner 40 may be disposed under the lower surface of the inner cabinet 100. The air conditioner 40 may be disposed so as to be spaced apart from the floor of the bathroom by a predetermined distance. The air conditioner 40 may be spaced apart from the floor of the bathroom by a predetermined distance to discharge air toward the floor of the bathroom.

The air conditioner 40 may include a housing 44 having therein a suction port 41, a first discharge port 42 for drying the floor of the bathroom, and a second discharge port 43 for drying the interiors of the modules disposed in the cabinet, a fan 46 disposed inside the housing 44 for moving air from the suction port 41 to the first discharge port 42 or to the second discharge port 43, and a vane 47 for discharging the air flowing in the housing 44 through the first discharge port 42 or through the second discharge port 43. The air conditioner 40 may further include a heater 45 for heating the air flowing therein.

The first module 50 may be configured to dry objects such as bathroom utensils that can be used in the bathroom. The first module 50 may dry utensils received therein using hot air discharged from the air conditioner 40.

The first module 50 may include a first module drawer 52 movably disposed in the cabinet and having a space defined therein, a basket 54 detachably disposed in the first module drawer 52, and a rack 56 disposed in the basket 54 for holding utensils. The first module 50 and the second module 60 may configured as a drawer, and hence, may also be referred to herein as a heated drawer assembly.

The interior of the first module drawer 52 may be hollow, and a top of the first module drawer 52 may be open. Consequently, the basket 54 may be inserted or removed through the open top of the first module drawer 52.

The first module 50 may further include a first module suction member 58 (or air inlet, connection duct) having therein a suction channel connected to the air conditioner 40 and a first module discharge member 59 having a discharge port for discharging air from the first module 50.

A residual water suction device, which can be used in the bathroom, may be included in the second module 60. The second module 60 may remove residual moisture from the residual water suction device. The second module 60 may also be configured to charge a rechargeable battery in the residual water suction device.

The residual water suction device, which may be included in the second module 20, is a device that removes residual water from the wall of the bathroom by suctioning the same. The residual water suction device may include a main body having a suction module for suctioning a fluid, a liquid-gas separator connected to the main body for separating the suctioned fluid into gas and liquid, and a suction nozzle having a suction port for suctioning the fluid through the operation of the suction module.

The residual water suction device may be divided into the suction nozzle, the liquid-gas separator, and the main body. The second module 60 may include therein the suction nozzle, the liquid-gas separator, and the main body of the residual water suction device in order to dry the suction nozzle, the liquid-gas separator, and the main body.

The second module 60 has therein a plurality of receiving spaces for receiving the separate components of the residual water suction device. The second module 60 may include a second module drawer 62, which may be movably disposed in the cabinet and which defines a plurality of reception units for receiving the separate components of the residual water suction device, and a plurality of fans for generating airflow to the respective reception units (or recesses).

The second module 60 may include a suction member 69 having therein a suction port, through which air flows into the second module drawer 62. A discharge channel, through which air moved by the fans is discharged, may be defined between the upper side of the second module drawer 62 of the second module and the upper surface 102 of the inner cabinet 100.

The second module 60 may include a front cover 66 disposed at the front of the second module drawer 62 and a second module drawer handle 68 protruding from the upper end of the front cover 66. The front cover 66 may cover a portion of the open front of the inner cabinet 100. The front cover 66 of the second module 60 may cover the front of the third module 70 disposed above the inner cabinet 100.

The third module (or the "additional module") 70 may be disposed between the inner cabinet 100 and the wash bowl 22. The third module 70 may be disposed in a space defined by the upper side of the inner cabinet 100 and the lower side of the wash bowl 22. The third module 70 may be disposed in a space defined by the curved bottom of the wash bowl 22 and the upper surface of the inner cabinet 100.

The third module 70 may be disposed inside the front cover 66 of the second module 60. The third module 70 can be withdrawn in a state in which the second module 60 has been withdrawn forward. That is, the third module 70 may be accessible when a door for the second module 60 is opened.

The third module 70 may include a third module drawer 72, which is movably disposed between the inner cabinet 100 and the wash bowl 22 and which has therein a plurality of storage spaces, and a front part 74 for covering the front surface of the third module drawer 72.

A plurality of storage spaces may be provided in the third module drawer 72. The storage spaces of the third module drawer 72 may accommodate a purification filter 76 for purifying the water that is supplied to the water supply valve 24, a temperature controller for controlling the temperature of the water that is supplied to the water supply valve 24, a printed circuit board for controlling the operation of the first module 50 or the second module 60, or a converter for converting AC electric power to DC electric power.

The washstand 10 may include an upper cover 80 disposed between the wash bowl 22 and the cabinet for primarily blocking water falling from the wash bowl 22. The third module 70 may be disposed under an upper cover 80. The upper cover 80 may protrude further forward than the third module 70.

The washstand 10 may include an input unit 82 for allowing a user to input a command for operating the air conditioner 40 or the modules. The input unit 82 may be disposed at one side of the upper cover 80. The washstand 10 may further include legs 84 (or supports) that supports the cabinet and raises the cabinet to provide a prescribed amount of spacing between the cabinet and the floor of the bathroom.

Figure 4:
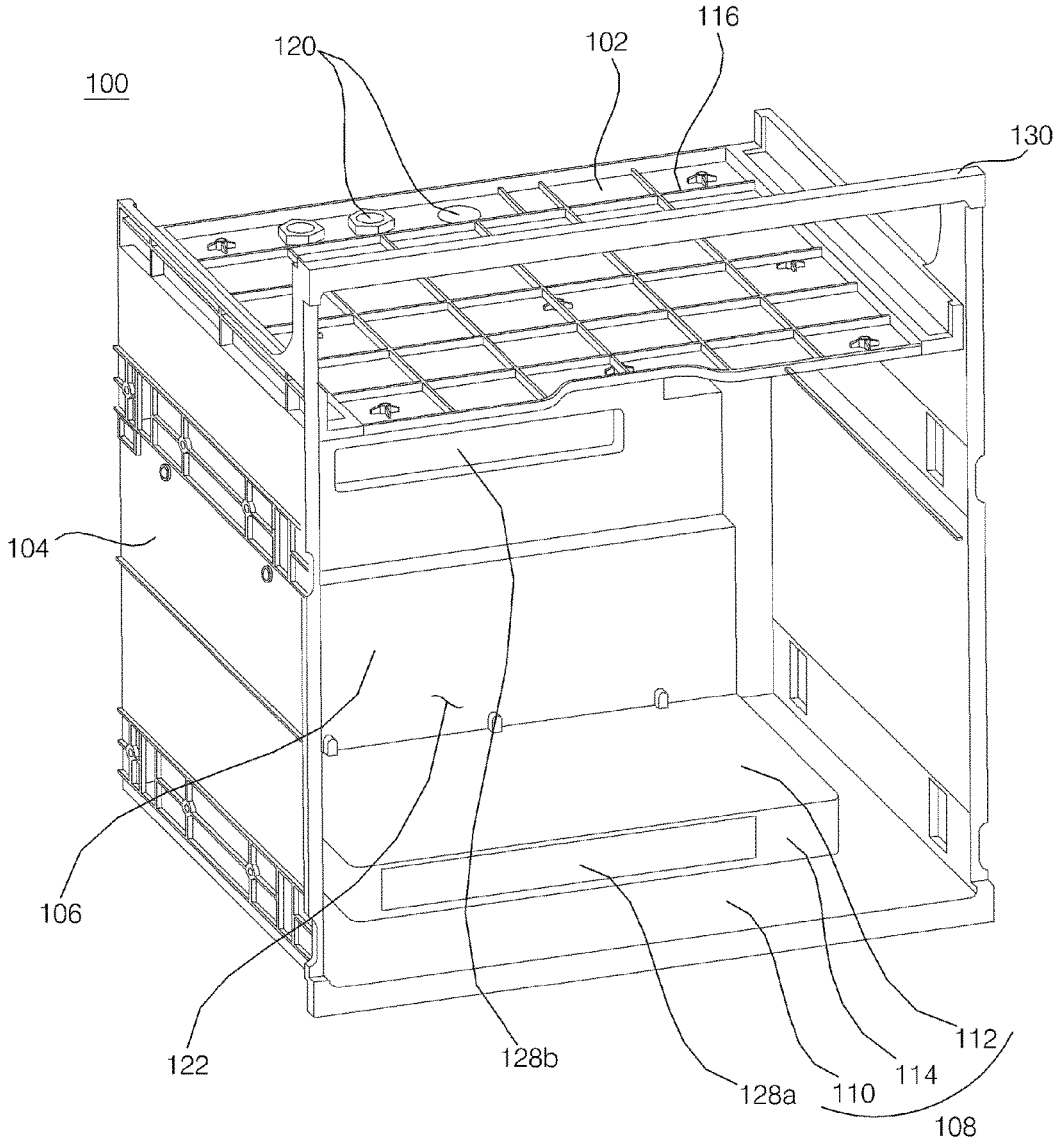
FIG. 4 is a perspective view showing an inner cabinet according to an embodiment of the present disclosure.
Figure 5:
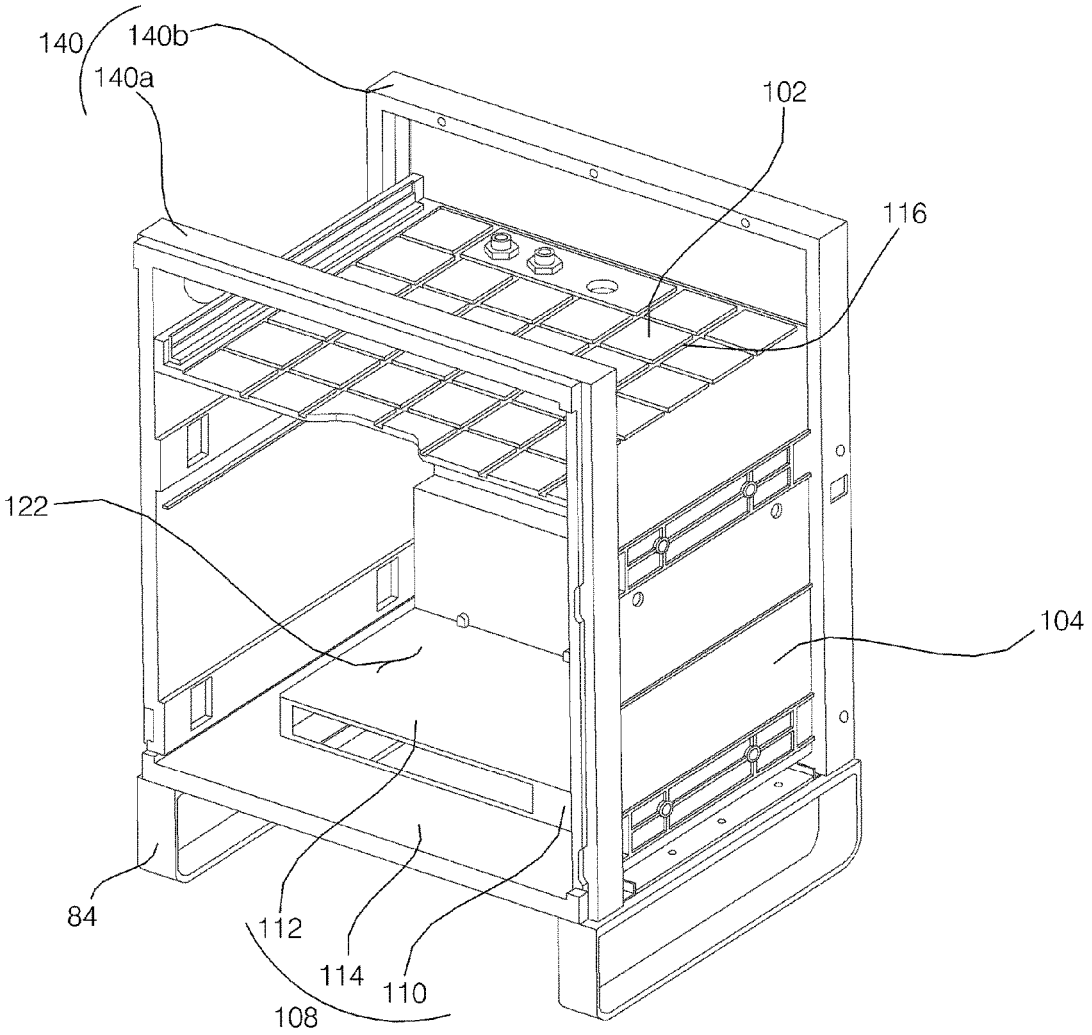
FIG. 5 is a view showing the state in which the inner cabinet, a frame, and legs according to an embodiment of the present disclosure are coupled to each other.
Figure 6:
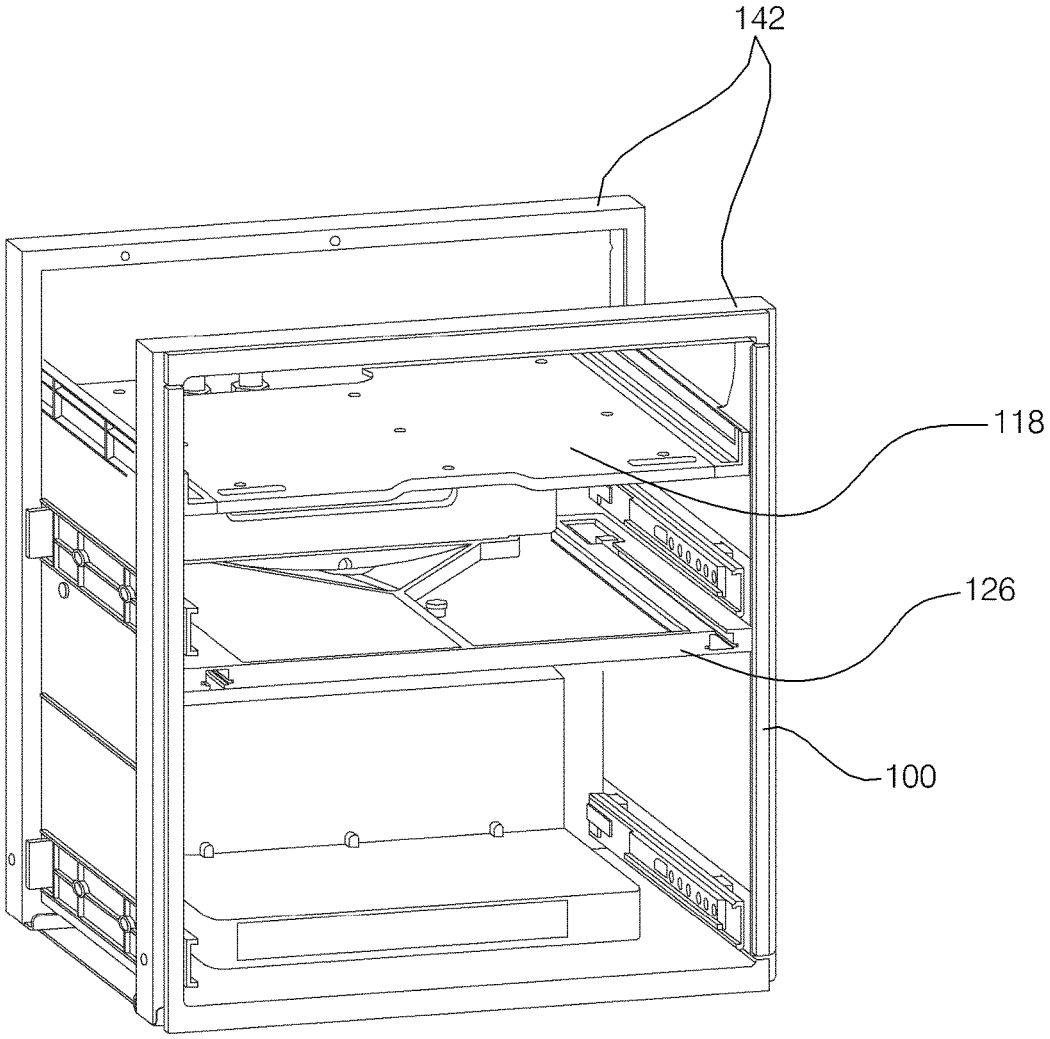
FIG. 6 is a view showing the state in which the inner cabinet, the frame, and a partition block according to an embodiment of the present disclosure are coupled to each other.
Figure 7:
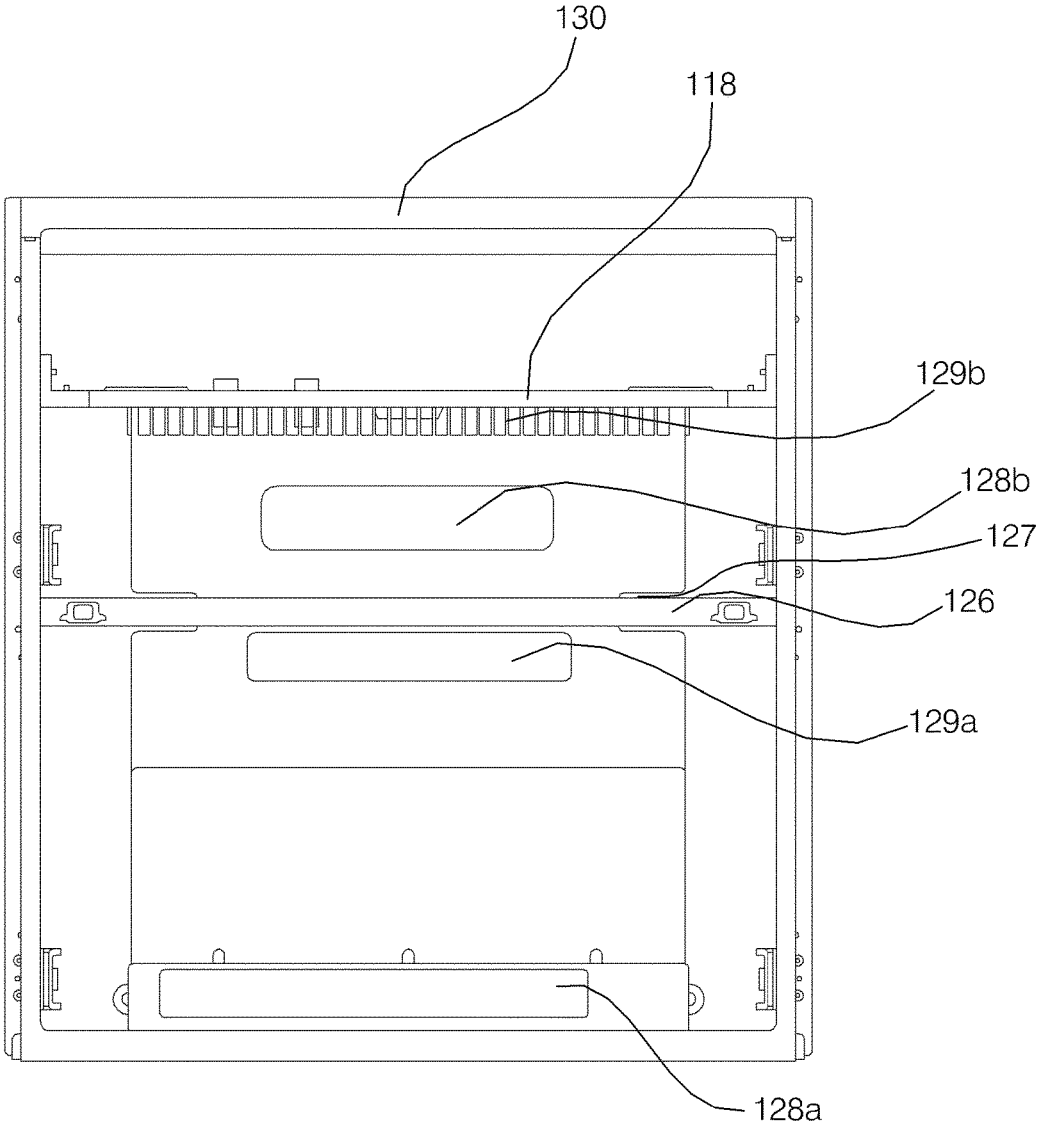
FIG. 7 is a front view of FIG. 6.
Figure 8:
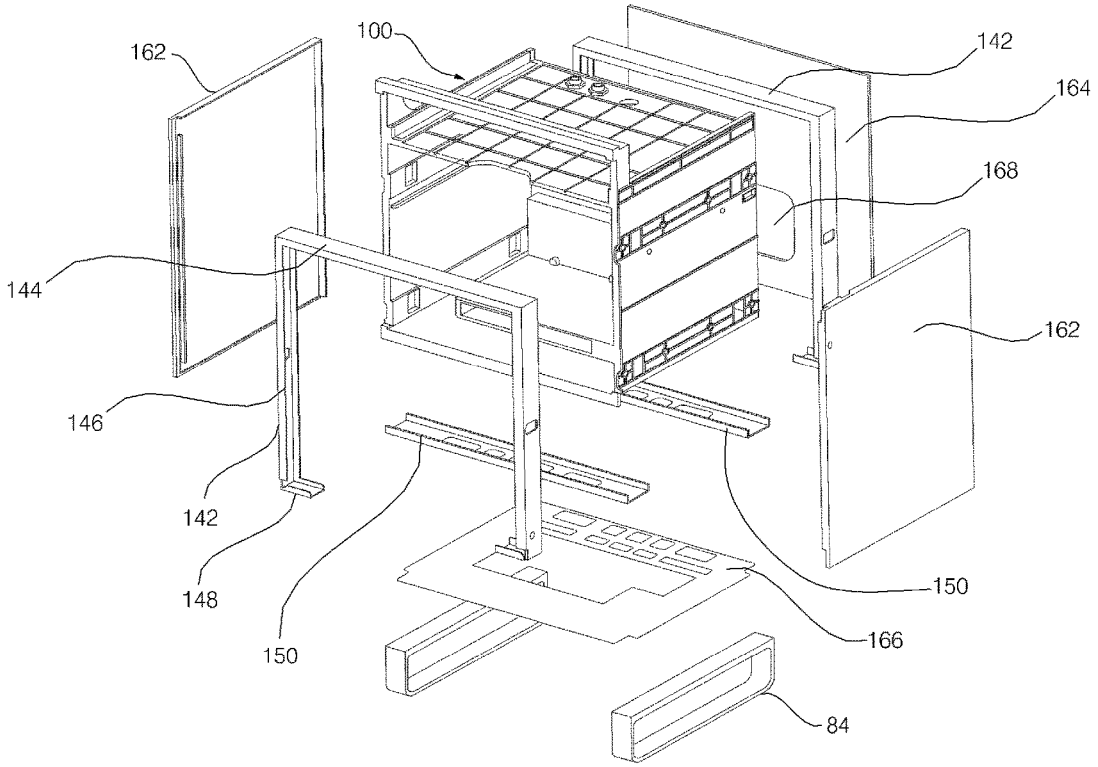
FIG. 8 is an exploded view showing the inner cabinet, the frame, the legs, and an outer cabinet according to an embodiment of the present disclosure.
Figure 9:
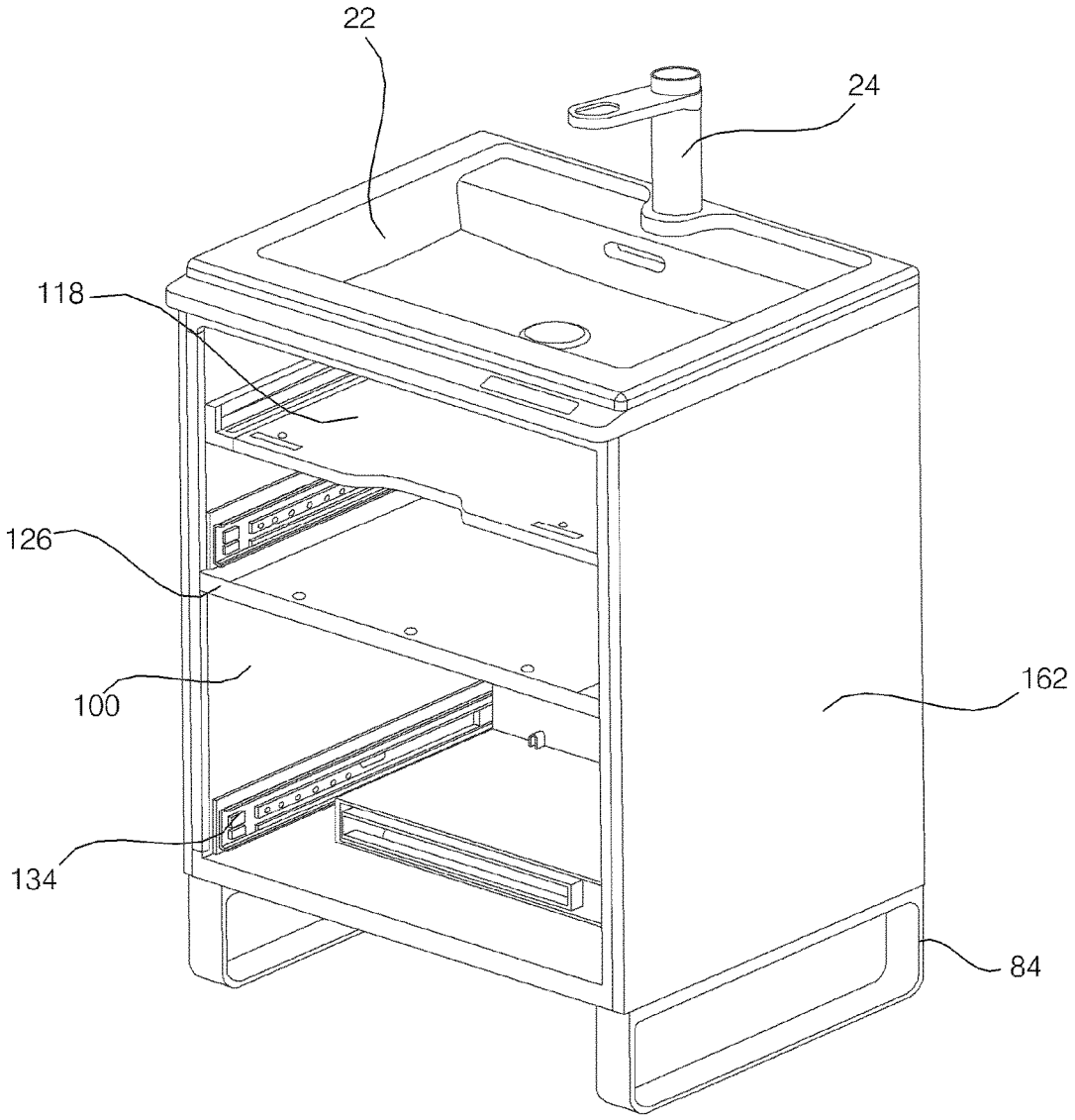
FIG. 9 is a view showing the washstand furniture, from which a module according to an embodiment of the present disclosure has been removed.

FIG. 4 is a perspective view showing an inner cabinet. FIG. 5 is a view showing the inner cabinet, the frame, and legs coupled to each other. FIG. 6 is a view showing the inner cabinet, the frame, and a partition block coupled to each other. FIG. 7 is a front view of FIG. 6. FIG. 8 is an exploded view showing the inner cabinet, the frame, the legs, and an outer cabinet. FIG. 9 is a view showing the washstand from which a module has been removed.

Hereinafter, the inner cabinet, the frame, and the outer cabinet will be described with reference to FIGS. 4 to 9. The inner cabinet 100, which is disposed under the wash device, may have a space therein for receiving the modules. The inner cabinet 100 may partition a space for receiving the module and a space for receiving the water supply and drainage devices from each other.

Referring to FIG. 4, the inner cabinet 100 may be formed in the shape of a hollow box. The inner cabinet 100 may be formed in the shape of a box that is open at the front thereof. The module may be inserted into the inner cabinet 100 through the open front. Only the front of the inner cabinet 100, through which the module is inserted, may be open in order to prevent external water from being introduced into the inner cabinet. The inner cabinet 100 may be made of plastic.

The inner cabinet 100 may be provided at one side thereof with a lattice type reinforcement-projecting part 116 (or reinforcing ribs, protrusions) for maintaining the rigidity of the inner cabinet 100. The inner cabinet 100 may be provided at the upper surface 102 with a lattice type reinforcement-projecting part 116 for maintaining the rigidity of the inner cabinet 100. The reinforcing protrusions may be arranged in a lattice pattern on the upper surface 102 of the inner cabinet 100.

Referring to FIG. 6, an upper cover 118 for covering the upper side of the inner cabinet 100 at which the reinforcement-projecting part 116 is formed may be disposed at the upper surface 102 of the inner cabinet 100. Holes 120, through which the drainage pipe 30 and the water supply hose 26 extend, may be formed in the rear side of the upper surface 102 of the inner cabinet 100.

The rear surface 106 of the inner cabinet 100 may be bent vertically downward from the part thereof that is spaced apart inward from the rear end of the upper surface 102. A module reception unit 122 (or module reception recess) for receiving the modules may be formed in front of the rear surface 106, and an external connection unit 124 (or external connection recess/channel/path), which communicates with the outside, may be formed at the rear of the rear surface 106.

The module reception unit 122 may be separated from a space defined between the wash bowl 22 and the upper surface 102 of the inner cabinet 100 and from the external connection unit 124. The water supply assembly and the drainage assembly may be disposed in the space defined between the wash bowl 22 and the upper surface 102 of the inner cabinet 100 and in the external connection unit 124, whereby external water may be prevented from being introduced into the module reception unit.

The module may be received in the module reception unit 122 of the inner cabinet 100. In the inner cabinet 100, a portion of the water supply assembly and a portion of the drainage assembly may be disposed in the external connection unit 124. A portion of the water supply hose 26 and the drainage pipe 30 may be disposed in the external connection unit of the inner cabinet 100. One or more modules may be included in the module reception unit 122. The first module 50 and the second module 60 may be provided in the module reception unit 122 of the inner cabinet 100.

The washstand 10 may include a rail member 134 (or rail) for moving the modules 50 and 60 received in the module reception unit 122 of the inner cabinet 100 in forward and rearward directions. The rail member 134 may be disposed inside the inner cabinet 100.

A partition block 126 may be disposed in the module reception unit 122 of the inner cabinet 100 in order to partition a space in which the first module 50 is disposed and a space in which the second module 60 is disposed from each other. Referring to FIGS. 6 and 7, the partition block 126 may partition the module reception unit 122 of the inner cabinet 100 into a plurality of spaces.

The first module 50 and the second module 60 may be vertically disposed in the module reception unit 122 by the partition block 126. The partition block 126 may supply electric power to the vertically disposed modules. The partition block 126 may be coupled into a recess formed in the inner cabinet 100 in a fitting fashion to increase the rigidity of the inner cabinet 10. The recess may be formed on a surface inside the inner cabinet 100 and configured for mounting the partition block 126.

The air conditioner 40, which discharges air to the module reception unit 122 of the inner cabinet 100 in order to dry the floor of the bathroom or to dry the interior of the first module 50, may be disposed at the lower side of the inner cabinet 100.

The inner cabinet 100 may be provided in at least one surface thereof with communication holes 128 and 129, through which airflow through the modules may flow out of the inner cabinet 100. The inner cabinet 100 may be provided in the rear surface 106 and the lower surface 108 thereof with communication holes, through which the interiors of the modules communicate with the external connection unit 124. The communication holes may include introduction holes 128*a* and 128*b* for introducing air into the modules and discharge holes 129*a* and 129*b* for discharging the air from the modules.

Referring to FIG. 7, the inner cabinet 100 may be provided in the lower surface 108 or the rear surface 106 thereof with introduction holes 128*a* and 128*b* or discharge holes 129*a* and 129*b*. The inner cabinet 100 may be provided in the rear surface 106 thereof with a discharge hole 129*a* for discharging air from the first module 70, an introduction hole 128*b* for introducing air into the second module 60, and a discharge hole 129*b* for discharging the air from the second module 60. The inner cabinet 100 may be provided in the lower surface 108 thereof with an introduction hole 128*a* for introducing air into the first module 50.

The lower surface 108 of the inner cabinet 100 may include a first lower surface 110, a second lower surface 112 spaced apart from the first lower surface 110 toward the inside of the inner cabinet 100 so as to provide a space in which the air conditioner 40 is disposed, and a connection surface 114 interconnecting the first lower surface 110 and the second lower surface 112. The connection surface 114 may be perpendicular to the first lower surface 110 and the second lower surface 112.

The air conditioner 40 may be disposed under the second lower surface 112. The introduction hole 128*a* for introducing air into the first module 50 may be formed in the connection surface 114. A portion of the air conditioner 40 may extend through the introduction hole 128*a* in the connection surface 114.

The external connection unit 124 may be a space or recess defined between the rear surface 106 of the inner cabinet 100 and a rear-outer cabinet 164, which will be described below. The external connection unit 124 may be separated from the module reception unit 122. The external connection unit 124 and the module reception unit 122 may be separated from each other with respect to the rear surface 106 of the inner cabinet 100.

The external connection unit 124 may be a space or recess defined between the rear surface 106 of the inner cabinet 100, which is spaced inward by a predetermined distance, and the rear-outer cabinet 164. The external connection unit 124 may be open at the lower part thereof so as to be connected to or in communication with the outside. The external connection unit 124 may be open at the lower part thereof such that air flowing in the modules is discharged out of the washstand 10. A plurality of openings may be provided to open the lower part while preventing certain amount of debris from entering the recess.

Under the external connection unit 124 may be disposed a support member 132 (or support, bracket) for maintaining the distance between the rear surface 106 of the inner cabinet 100 and the rear-outer cabinet 164. The support member 132 may be formed in a lattice shape in order to allow the external connection unit 124 and the washstand to communicate with each other and to increase the rigidity of the washstand. The support member 132 may be disposed under the water supply and drainage devices to prevent external foreign matter from being introduced into the water supply and drainage devices.

A portion of the water supply hose of the water supply assembly and a portion of the drainage pipe of the drainage assembly may be disposed in the external connection unit 124. The water supply hose of the water supply assembly and the drainage pipe of the drainage assembly disposed in the external connection unit 124 may have external connections through a through-hole 168 in the rear-outer cabinet 164.

The inner cabinet 100 may include an upper member 130 (or upper frame), which defines an entrance (or opening), through which the third module 70 may be inserted. The upper member 130 may protrude upward from the upper surface 102 of the inner cabinet 100. The upper member 130 may support the wash bowl. The upper member 130 is disposed in front of the upper surface 102 of the inner cabinet 100. The upper member 130 may extend from opposite sides 104 of the inner cabinet. The upper member 130 may extend laterally across the front of the inner cabinet 100 at a prescribed height above the upper surface of the inner cabinet 100. The upper member 130 may contact a front frame 140*a*, which will be described below.

The frame 140 may support the washstand 10. The frame 70 minimizes the magnitude of the load of the wash device that is transmitted to the inner cabinet 100. The frame 140 may be made of a sheet metal material, such as iron, aluminum, another appropriate metal, or an alloy. The frame 140 may increase the rigidity of the washstand 10. The frame 140 may also protect the external appearance of the inner cabinet 100.

The frame 140 may interconnect the inner cabinet 100 and the outer cabinet 160. The frame 140 may be disposed between the inner cabinet 100 and the outer cabinet 160. The frame 140 may be formed to have a space or recess in which a wire disposed in the washstand 10 may received.

The frame 140 may include a front frame 140*a*, which is disposed in front of the inner cabinet 100, and a rear frame 140*b*, which is disposed at the rear of the inner cabinet 100. The front frame 140*a* may surround the outside of the upper member 130 of the inner cabinet 100.

The frame 140 may have a quadrangular shape. The frame 40 may be formed in the shape of a quadrangular ring that surrounds the circumference of the inner cabinet 100. The frame 140 may contact the side surface and the lower surface 108 of the inner cabinet. The frame 140 may be connected to the wash bowl via the upper cover 80 at the upper side thereof.

The frame may support the load of the wash device. The frame 140 may include a main frame 142 for supporting the wash bowl 22 and a subframe 150 for interconnecting opposite ends, which are open, of the lower side of the main frame 142. The main frame 142 may be formed in the shape of a quadrangular ring that is open at the lower side thereof. The main frame 142 and the subframe 150 may be coupled to each other at the lower side of the inner cabinet 100.

The main frame 142 may include an upper bar 144, which is connected to the wash bowl 22, a pair of side bars 146 bent perpendicularly from opposite ends of the upper bar 144 so as to be disposed at opposite sides of the inner cabinet 100, and a pair of protruding lower bars 148 bent perpendicularly from the lower ends of the side bars 146 so as to be adjacent to each other. The subframe 150 may be disposed at the lower side of the lower surface 108 of the inner cabinet. The subframe 150 may interconnect the protruding lower bars 148 of the main frame 142.

The frame 140 may be connected to a base-outer cabinet 166 (or base-outer cabinet wall) at the lower side thereof. The frame 140 may be connected to the base-outer cabinet 166 via the legs 84 of the washstand at the lower side thereof. The frame 140 may transmit the load of the wash device to the legs of the washstand.

The frame 140 may be configured to have a space or recess defined therein in the state of being coupled to the inner cabinet 100. The cross-section of the frame 140 may be formed in the shape of a "[". That is, the cross-section may be formed by a first section and second and third sections that extend from opposite ends of the first section in a perpendicular direction. When the frame 140 is coupled to the inner cabinet 100, a space through which a wire extends may be formed therebetween.

The outer cabinet 160 may be disposed outside the inner cabinet 100. The outer cabinet 160 may prevent water or moisture from being introduced into the modules received in the inner cabinet 100. The outer cabinet 60 may be coupled to the frame 140. The outer cabinet 160 may be made of a sheet metal material to increase the rigidity of the washstand 10.

The outer cabinet 160 doubly blocks water from being introduced into the module reception unit 122 together with the inner cabinet 100. In the washstand 10, the outer cabinet 160 primarily blocks external water or moisture, and the inner cabinet 100 secondarily blocks the external water or moisture.

Referring to FIG. 8, the outer cabinet 160 may include a side-outer cabinet 162 (or side-outer cabinet wall) disposed at opposite side surfaces of the inner cabinet 100, a rear-outer cabinet 164 (or rear-outer cabinet wall) disposed at the rear surface 106 of the inner cabinet 100, and a base-outer cabinet 166 (or base-outer cabinet wall) disposed at the lower surface 108 of the inner cabinet 100.

The side-outer cabinet 162 may be connected to the frame at the opposite side surfaces of the inner cabinet 100. The side-outer cabinet 162 may cover the outside of the side surface 104 of the inner cabinet and increases the rigidity of the washstand 10.

The external connection unit 124 may be defined between the rear-outer cabinet 164 and the rear surface 106 of the inner cabinet 100. The rear-outer cabinet 164 may be provided in one side thereof with a through-hole 168, through which the drainage pipe 30 of the drainage assembly or the water supply hose 26 of the water supply assembly extends.

The base-outer cabinet 166 blocks water or moisture introduced from the bottom of the washstand 10. A space in which the air conditioner 40 is disposed may be defined between the base-outer cabinet 166 and the lower surface 108 of the inner cabinet 100.

Referring to FIG. 9, in the washstand 10, the inner cabinet 100, the frame 140, and the outer cabinet 160 may be coupled to each other in order to constitute a strong structure in which the module reception unit is defined.

As is apparent from the above description, the washstand according to the present disclosure has the following effects.

First, the washstand may include an inner cabinet and an outer cabinet. The inner cabinet may have therein a space for receiving modules, whereby external contaminants are doubly prevented from being introduced into the modules. In addition, the module reception unit may be separated from the space in which the wash device is disposed, whereby external contaminants are effectively prevented from being introduced into the modules received in the module reception unit.

Second, the washstand may include an inner cabinet, an outer cabinet, and a frame, by which a storage space is defined in the washstand and by which the rigidity of the overall structure of the washstand is maintained, whereby the modules received in the washstand are stably managed.

In accordance with the present disclosure, the above and other objects can be accomplished by the provision of washstand including: a wash device including a wash bowl, a water supply assembly for supplying water to the wash bowl, and a drainage assembly for draining the water supplied to the wash bowl; an inner cabinet disposed under the wash bowl, the inner cabinet having a space defined therein; an electrically operated module disposed in the inner cabinet; an outer cabinet covering the outside of the inner cabinet; and a frame for fastening the inner cabinet and the outer cabinet and for supporting the load of the wash device, whereby it is possible to support the wash device and to prevent contamination of the module disposed in the inner cabinet.

The inner cabinet may be provided at the upper surface thereof with a lattice type reinforcement-projecting part. The washstand may further include a partition block for partitioning the module reception unit of the inner cabinet into a plurality of spaces, wherein the partition block may be coupled into a recess formed in the inner cabinet in a fitting fashion, whereby the rigidity of the inner cabinet may be increased.

The frame may be formed in the shape of a quadrangular ring that surrounds the circumference of the inner cabinet, the frame may have a sectional shape of a "[," by which a space is defined therein, and the frame may include a front frame disposed in front of the inner cabinet and a rear frame disposed at the rear of the inner cabinet, whereby the overall rigidity of the washstand may be increased.

The outer cabinet may include a side-outer cabinet disposed at opposite side surfaces of the inner cabinet, a rear-outer cabinet disposed at the rear surface of the inner cabinet, and a base-outer cabinet disposed at the lower surface of the inner cabinet. An external connection unit, in which a portion of the water supply assembly and a portion of the drainage assembly are disposed, may be defined between the rear-outer cabinet and the rear surface of the inner cabinet. A support member for maintaining the distance between the rear surface of the inner cabinet and the rear-outer cabinet may be disposed under the external connection unit, whereby the rigidity of the washstand may be increased.

Those skilled in the art will appreciate that the present disclosure may be carried out in specific ways other than those set forth herein without departing from the spirit and essential characteristics of the present disclosure. The above embodiments are therefore to be construed in all aspects as illustrative and not restrictive. The scope of the disclosure should be determined by the appended claims and their legal equivalents, not by the above description, and all changes coming within the meaning and equivalency range of the appended claims are intended to be embraced therein.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. Washstand comprising:

a wash device including a wash bowl, a water supply assembly that supplies water to the wash bowl, and a drainage assembly that drains the water supplied to the wash bowl;

an inner cabinet disposed under the wash bowl;

an outer cabinet provided to cover an outside of the inner cabinet;

a frame for fastening the inner cabinet and the outer cabinet and for supporting a load of the wash device; and a second module provided between the inner cabinet and the wash bowl, the second module having a plurality of storage spaces, wherein the inner cabinet has an upper frame that extends laterally across a front side of the inner cabinet at a prescribed height over an upper surface of the inner frame, the upper frame forming an opening through which the second module is inserted.

2. The washstand of claim 1, further comprising at least one electrically operated module provided in the inner cabinet.

3. The washstand of claim 2, wherein the inner cabinet is formed in a shape of a box that is open at a front side, wherein at least one of the electrically operated module is received through the open front of the inner cabinet.

4. The washstand of claim 1, wherein the inner cabinet includes a plurality of reinforcement protrusions arranged in a lattice pattern on an upper surface of the inner cabinet.

5. The washstand of claim 2, wherein a module reception recess that accommodates the at least one electrically operated module is formed in front of a rear surface of the inner cabinet, and wherein an external connection recess, which communicates with an outside of the washstand, is formed at a rear of the rear surface of the inner cabinet.

6. The washstand of claim 5, wherein a communication hole is provided on the rear surface of the inner cabinet, wherein the module reception recess communicates with the external connection recess through the communication hole.

7. The washstand of claim 5, wherein a portion of the water supply assembly and a portion of the drainage assembly are provided in the external connection recess.

8. The washstand of claim 5, further comprising:

a partition block that partitions the module reception recess of the inner cabinet into a plurality of spaces, wherein the partition block is fitted into a recess formed on a surface inside the inner cabinet to mount the partition block.

9. The washstand of claim 1, wherein the upper frame is configured to support the wash bowl and the frame is provided to surround the upper frame.

10. The washstand of claim 1, wherein the frame includes a front frame provided in front of the inner cabinet and a rear frame provided at a rear of the inner cabinet.

11. The washstand of claim 1, wherein the frame has a quadrangular shape that surrounds a circumference of the inner cabinet.

12. The washstand of claim 1, wherein the frame includes a main frame that supports the wash bowl, the main frame having a quadrangular shape that is open on one side, and a subframe that coupled across the open side of the main frame.

13. The washstand of claim 1, wherein a cross-section of the frame has a prescribed shape which forms a space in the frame.

14. The washstand of claim 13, wherein the prescribed shape of the cross-section is formed by a first section and second and third sections that extend from opposite ends of the first section, in a direction perpendicular to the first section.

15. The washstand of claim 1, wherein the outer cabinet includes a side-outer cabinet wall provided at opposite side surfaces of the inner cabinet, a rear-outer cabinet wall provided at a rear surface of the inner cabinet, and a base-outer cabinet wall provided at a lower surface of the inner cabinet, and wherein an external connection recess, in which a portion of the water supply assembly and a portion of the drainage assembly are provided, is defined between the rear-outer cabinet wall and a rear surface of the inner cabinet.

16. The washstand of claim 15, wherein the rear-outer cabinet wall has a through-hole, the portion of the water supply assembly and the portion of the drainage assembly being externally connected through the through-hole.

17. The washstand of claim 15, further comprising a support member provided between the rear surface of the inner cabinet and the rear-outer cabinet wall and configured to maintain a distance between the inner cabinet and the rear-outer cabinet wall.

18. The washstand of claim 15, further comprising:

a dryer that generates airflow into the inner cabinet, wherein the dryer is provided between the lower surface of the inner cabinet and the base-outer cabinet wall.

19. The washstand of claim 1, wherein the frame and the outer cabinet are made of sheet metal.

* * * * *